United States Patent [19]

Napolitano

[11] Patent Number: 4,515,180

[45] Date of Patent: May 7, 1985

[54] VALVE FOR SELF-PRIMING PUMP SYSTEM

[75] Inventor: Pellegrino E. Napolitano, Middletown, N.J.

[73] Assignee: Hudson Engineering Company, Bayonne, N.J.

[21] Appl. No.: 448,235

[22] Filed: Dec. 9, 1982

[51] Int. Cl.[3] ..... B63 1/00

[52] U.S. Cl. ..... 137/565; 417/199 A; 417/200

[58] Field of Search ..... 417/200, 199 A; 137/565

[56] References Cited

U.S. PATENT DOCUMENTS

| | | | |
|---|---|---|---|
| 1,997,418 | 4/1935 | Hornschuch et al. | 417/199 A |
| 2,897,764 | 8/1959 | Tracy | 417/200 |
| 3,370,604 | 2/1968 | Napolitano | 417/199 A |
| 3,381,618 | 5/1968 | Napolitano | 417/199 A |

*Primary Examiner*—A. Michael Chambers
*Attorney, Agent, or Firm*—Fleit, Jacobson, Cohn & Price

[57] ABSTRACT

A self-priming pump system including a priming valve for automatically providing priming liquid to a pump which has lost suction. The priming liquid is contained within the pump discharge column between a pair of spaced check valves. The priming valve is in communication with the priming liquid column and is activated by the static pressure head difference between the discharge column and the pump outlet to cause the valve to open upon loss of pump suction, which is reflected in a drop of static pressure head at the pump outlet. The priming valve includes a valve member connected to a piston which is received in a cylinder in communication with the discharge column. A bleed valve and bleed conduit extend from the cylinder to control the pressure level at which the valve will be actuated.

17 Claims, 5 Drawing Figures

VALVE FOR SELF-PRIMING PUMP SYSTEM

BACKGROUND OF THE INVENTION

This invention relates to self-priming pump systems whereby a quantity of pumped liquid is permitted to flow to the suction side of a pump when suction has been lost, and more particularly to an improved valve structure which is operable in response to a loss of suction to automatically cause liquid to return to the suction side of the pump.

Self-priming liquid pumping systems are well known, and examples of systems of that type are illustrated in U.S. Pat. Nos. 3,370,604 and 3,381,618, each of which patents is commonly owned by the assignee of the present invention. As disclosed in those patents, a pump is positioned so that its suction inlet line is submerged in a suction chamber. The discharge line from the pump includes a downstream check valve to prevent reverse flow through the discharge line back to the pump when suction is lost. A priming valve is positioned between the pump discharge and the downstream check valve. The column of liquid between the priming valve and the check valve constitutes the priming liquid, and the flow of the priming liquid back to the suction chamber is controlled by the priming valve.

Heretofore the known priming valve structures included a pressure sensing device which extended into the liquid flow stream to sense the dynamic pressure thereof and to convey the same to the valve in order to operate the priming system, or it included a flow constriction in the form of a venturi in order to sense the reduced static pressure which results from the higher liquid flow velocity at the venturi throat, again to operate the priming valve. Such pressure sensors and venturis decreased the overall efficiency of the pumping system by impeding the flow therethrough.

SUMMARY OF THE INVENTION

It is an object of the present invention to provide a priming valve structure which eliminates the need for a venturi to be positioned in the flow stream.

It is a further object of the present invention to provide a priming valve structure in a self-priming pump system wherein the need for flow-sensing devices which extend into the flow stream is eliminated.

It is another object of the present invention to provide a priming valve structure which includes means to vary the pressure level at which the valve is operable.

Briefly stated, in accordance with one aspect of the present invention, a self-priming pump system for a liquid pump is provided which includes an improved priming valve structure. The valve includes a valve housing having a rod slidably supported therein, and a valve member carried by the rod and supported for movement relative to the valve inlet. A valve seat is positioned within the valve housing and is cooperable with the valve member to selectively permit or prevent flow through the valve. A piston is provided within the valve housing and is carried by the rod. Conduit means are provided which interconnect the piston chamber with the liquid discharge column so that at the times when liquid is flowing through the pump and into the discharge conduit, the forces resulting from the liquid pressure acting on the piston assists in maintaining the valve in the closed position. During those times when the pump has lost suction, and consequently there is no liquid flow through the discharge column, the forces resulting from the liquid pressure acting on the piston and valve member are such as to cause the valve to open to permit the column of priming liquid to flow through the valve outlet into the pump suction chamber in order to prime the pump.

DESCRIPTION OF THE PREFERRED EMBODIMENTS

Figure 1:
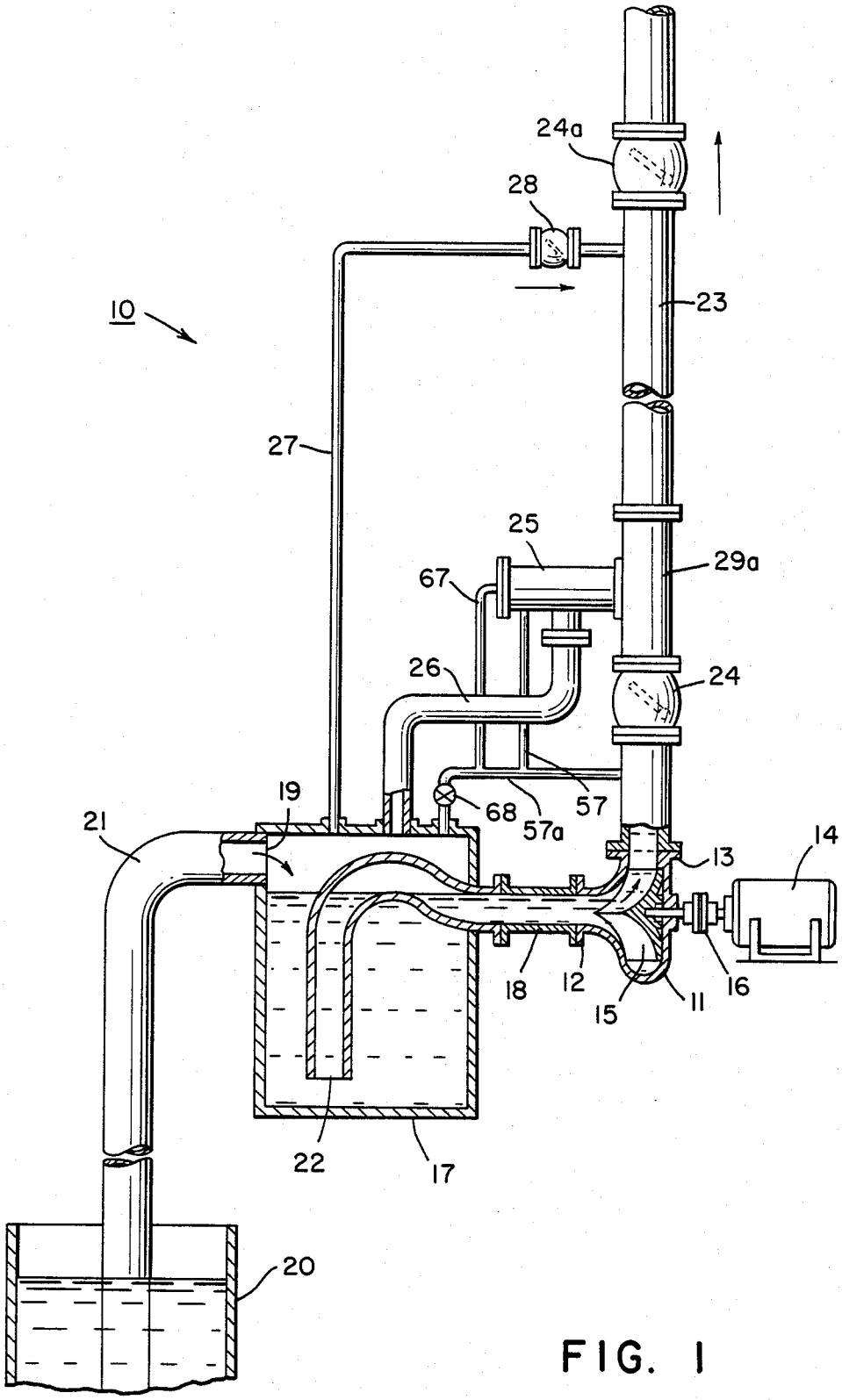
FIG. 1 is a side elevational view, partially in section, illustrating a self-priming system incorporating a priming valve structure in accordance with the present invention.

Referring now to the drawings, and particularly to FIG. 1 thereof, there is shown a liquid flow system 10 which includes a pump 11 having an inlet 12 and an outlet 13. The pump as shown is a single stage pump, but a similar horizontally-arranged, multiple stage pump could also be provided, if desired. Pump 11 is driven by a suitable drive means, such as, for example, an electric motor 14, which is connected to the pump impeller 15 by means of a suitable drive connection 16. A suction tank 17 is provided and includes a conduit 18 which communicates with pump inlet 12 to provide to the suction side of pump 11 the liquid which is to be conveyed. Suction tank 17 is a generally closed structure which includes an opening 19 adjacent its upper portion and which is in communication with a source of liquid, which can be a separate storage tank 20, as shown, through a pipe 21. Preferably the inlet line to pump 11 includes a pipe which has an inlet opening 22 submerged within the liquid in suction tank 17. The system illustrated is such that suction tank 17 is maintained with sufficient liquid by virtue of the reduced pressure which occurs when the liquid therein contained is pumped therefrom, whereby atmospheric pressure acting on the surface of the liquid in storage tank 20 serves to force the liquid through pipe 21 and into suction tank 17 in order to maintain suction liquid for the pump.

Pump outlet 13 is connected to a discharge line 23 which, as shown, preferably extends in a generally vertical direction and includes a first check valve 24 positioned immediately downstream of pump 11 and a second check valve **24*a* positioned downstream of first check valve 24 a sufficient distance to provide a column of liquid of predetermined volume. Positioned in discharge line 23 immediately downstream of check valve 24 is a priming valve 25, and a priming liquid conduit 26 extending therefrom to suction tank 17 to permit priming liquid to pass into suction tank 17 thus permitting the pump to prime itself again. The volume of liquid within discharge line 23 between check valve 24*a* and priming valve 25** provides a column of liquid which is of a sufficient quantity to permit priming of the pump.

A relief conduit 27 extends from the top of suction tank 17 to discharge line 23 just upstream of check valve 24 to permit expulsion of air previously drawn into the upper portion of suction tank 17. A relief line check valve 28 is provided in relief conduit 27 to allow movement of air only in a direction toward discharge line 23 in order to prevent liquid in discharge line 23 from returning to suction tank 17 through relief conduit 27. When the pump loses its prime, it is because the liquid in the suction tank 17 is exhausted and is replaced, by air or vapor. Full flow cannot be established within the system until and unless the air within the suction tank is expelled and replaced by liquid. Whereas conduit 27 does conduct the air from tank 17 to discharge conduit 23 through check valve 28, it does not constitute a means of escape but rather it provides a tranfer means; for when the liquid in discharge conduit 23, between check valve 24*a* and priming valve 25 begins to return to tank 17, because a flow path has been provided through the opening of valve 25, a vacuum will be created between the liquid column in 23 and check valve 24*a*. The dropping of the liquid level in conduit 23 causes air in tank 17 to be drawn up through relief conduit 27 and check valve 28 to replace the volume of liquid. When the total transfer of the controlled volume of liquid and air has taken place there will be enough liquid in tank 17 to reach the pump's impeller eye and the pump will be in primed pumping mode. The air that was contained within the discharge conduit cannot return to tank 17, because of check valve 28, and is therefore forced through check valve 24*a* and expelled from the system by the liquid piston caused by the pumpage in conduit 23.

Figure 2:
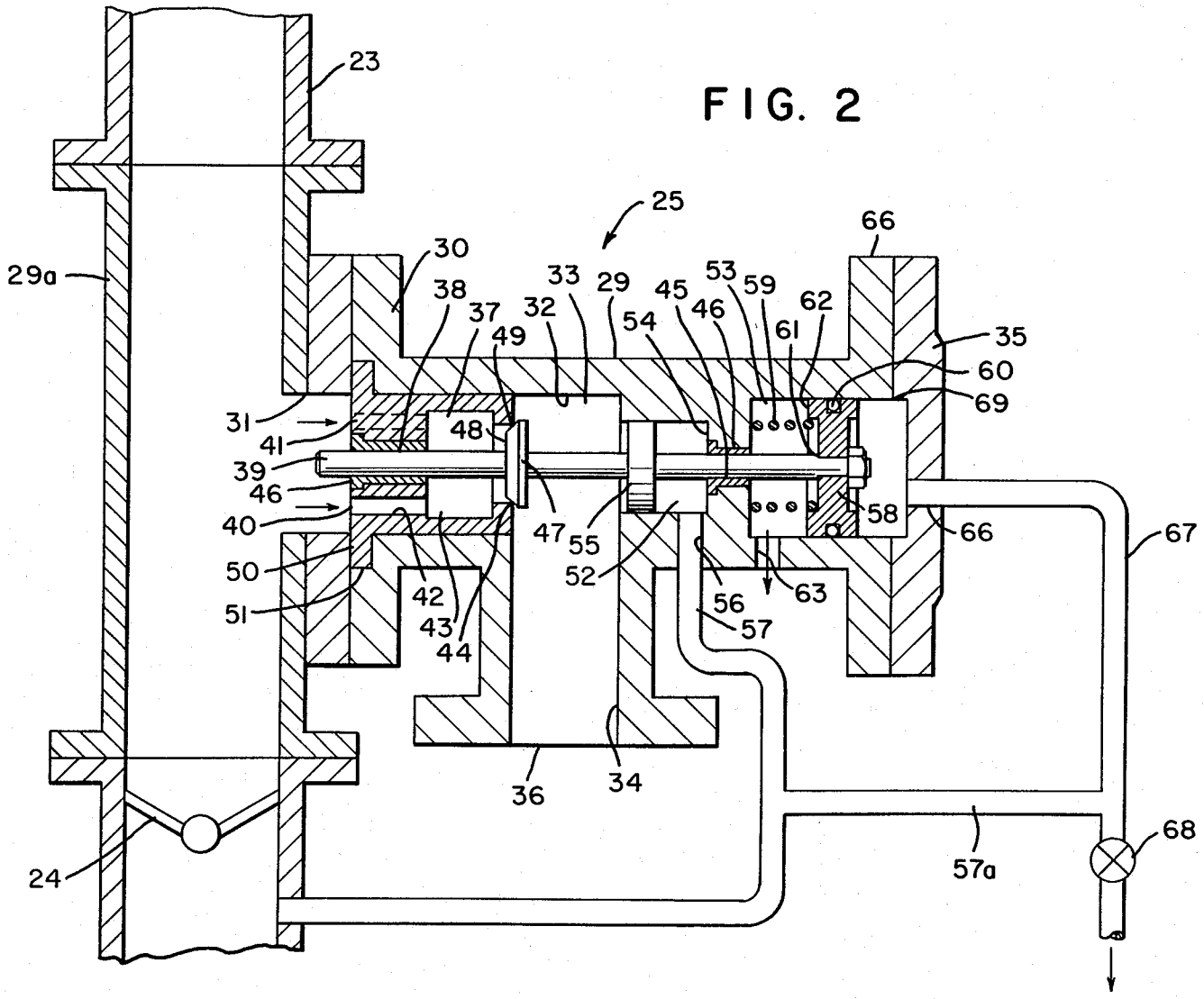
FIG. 2 is a fragmentary cross-sectional view showing one embodiment of a priming valve in accordance with the present invention.

Referring now to FIG. 2, there is shown a priming valve 25 in accordance with the present invention. A generally T-shaped valve housing 29 is provided which includes an outwardly extending flange 30 adapted to be bolted or otherwise secured to discharge line 23 so that an aperture 31 therein is in communication with valve housing 29. The connection of valve housing 29 to discharge line 23 can be made by incorporating a T-member 29*a* in discharge line 23, as shown in FIGS. 1 and 2. Housing 29 includes a pair of passageways having intersecting axes. A first passageway 32 extends from flange 30 to a chamber 33. A second passageway 34 extends from first passageway 32 at a point intermediate the inlet and closure member 35, which is spaced from and opposite flange 30, communicates with the valve outlet 36, which, in turn, is connected by way of return conduit 26 (see FIG. 1) to suction tank 17. Chamber 33 includes a sleeve member 37 having a central bore 38 supporting a rod 39 for axial sliding movement relative to first passageway 32. Sleeve 37 incorporates valve inlet 40, and can be in the form of a cylindrical sleeve press fitted into passageway 32 and having radially directed struts 41, the spaces between which define a series of axial passageways 42 to permit communication between discharge line 23 and the interior sleeve chamber 43. Sleeve member 37 also includes a valve seat 44 which defines a valve opening.

Rod 39 is also slidably supported in a second bore 45 positioned within housing 29 at a point beyond the intersection of first passageway 33 and second passageway 34. In connection with each of rod support bores 38 and 45, suitable inserts 46 can be provided in the form of replaceable bearing elements to minimize friction.

Positioned on rod 39 is a valve member 47 which can be a disk-like structure such as the poppet valve shown in FIG. 2. Valve member 47 preferably includes a valve face 48 with an obliquely oriented edge 49 which cooperates with valve seat 44 to close the valve opening. Valve seat 44 is integral with sleeve 37, which extends partially within first passageway 32. In any event, valve seat 44 is positioned at a point between valve inlet 40 and the point of intersection between first and second passageways 32, 34, respectively.

When an insert in the form of a sleeve 37 is utilized to provide valve seat 44 and bearing 46, replacement to provide either a new valve seat or a new bearing in the event of wear is greatly facilitated. Sleeve 37 preferably is tightly received within first passageway 32 and includes an outwardly extending flange 50 which is cooperable with a similarly configured annular recess 51 in valve housing 29 to prevent movement of sleeve 37 inwardly beyond a predetermined point within first passageway 32. Additionally, the tight fit of sleeve 37 in first passageway 32 also serves to accurately position insert 46 in axial alignment with insert 45.

Positioned within valve housing 29 and on the opposite side of the intersection of first and second passageways 32, 34 from valve seat 44 are a pair of spaced chambers 52, 53, respectively, each of which is separated by a partition 54 which carries sleeve bearing 46 within which rod 39 is slidably received. Chamber 52, which is closest to second passageway 34, slidably receives a piston 55 which is secured to rod 39. The cross-sectional area of chamber 52 is substantially equal to that of valve seat 44, and the effective cross-sectional area of piston 55 is equal to the effective cross-sectional area of valve member 47. Chamber 52 includes an opening 56 on the opposite side of piston 55 to permit communication with discharge line 23 by means of a conduit 57, which joins discharge line 23 at a point upstream of first check valve 24.

Chamber 53 has a greater cross-sectional area than that of chamber 52, and includes piston 58 slidably received therein and which also is carried by rod 39. The effective cross-sectional area of piston 58 is greater than that of piston 55. A compression spring 59 is positioned within chamber 53 to bias piston 58 in a direction away from valve seat 44, to provide a normally open valve structure.

Piston 58, which is preferably in liquid-tight relationship with the wall of chamber 53, can include a sealing ring 60, such as an O-ring, or the like, positioned in the outer surface thereof to facilitate a liquid-tight seal. Additionally, piston 58 can be secured to rod 39 by means of a reduced diameter portion which engages a shoulder 61 in rod 39 against which inner face 62 of piston 58 rests. The reduced diameter portion of rod 39 can include a threaded end on which a nut can be positioned in order to secure piston 58 in position on rod 39.

Chamber 53 includes a vent passageway 63 in communication with the ambient atmosphere and which extends from the area of chamber 53 defined by piston face 62 and partition 54 in order to provide pressure relief and thereby prevent any pressure build-up in that portion of the chamber.

A passageway 66 is provided in closure member 35 and is in communication with suction tank 17 by means of conduit 67. A flow control valve 68, which can be a needle valve, or the like, is provided to control the pressure in chamber 69. Conduit 67 is interconnected with conduit 57 by means of conduit 57*a* to permit communication between chamber 69 and the portion of discharge line 23 upstream of check valve 24.

In operation, when pump 11 is pumping liquid through discharge line 23, the forces resulting from the liquid static pressure acting on valve face 48 coupled with the spring force acting on piston 58 combine to urge valve member 47 into an open position relative to valve seat 44. At the same time, however, the same liquid static pressure in discharge line 23 is communicated to each of chambers 52 and 69, through conduits 57, and 57*a*, and 67, respectively, and acts against pistons 55 and 58, respectively, to urge rod 39 in the opposite direction so that valve member 47 is against valve seat 44 to thereby close the valve. When the combination of the two latter liquid static pressure forces is sufficient to overcome the spring force and the force of the liquid static pressure acting on valve face 48, the valve is in closed condition.

It will be noted that because the piston area of piston 55 is equal to the area of valve face 48, and since the same pressures are acting upon each of those respective areas, the static pressure force acting upon valve face 48 is counterbalanced by the static pressure force acting upon piston 55. Therefore, spring 59 is so selected that under normal operating conditions the spring force is overcome by the force resulting from the liquid pressure conveyed through conduits 57, 57*a*, and 67 to act on the outer face of piston 58 and thereby maintain the valve in closed condition.

When for one reason or another pump 11 loses suction, the column of liquid contained within discharge line 23 between check valve 24*a* and priming valve 25 provides the priming liquid. When pump suction is lost, there is no flow through the system and therefore the static pressure within discharge line 23 is the static head of the liquid therein contained. Because of the lower pressure then existing in discharge line 23 as compared with the pressure existing when pump 11 is operating to cause flow through the system, the force acting through conduits 57, 57*a*, and 67 on the outer face of piston 58 is insufficient to overcome the force of spring 59 acting in the opposite direction, and therefore valve member 47 is moved away from valve seat 44, permitting the valve to open, to thereby allow the liquid column in discharge line 23 to flow through valve outlet 36 and to suction tank 17 to provide sufficient liquid to once again prime the pump for continued operation.

Pressure control valve 68 is provided to permit the flow through conduits 57, 57*a*, and 67 to be adjusted in order to maintain a desired pressure within chamber 69 and thereby control the pressure operating on piston 58 in opposition to spring 59 and tending to close valve member 47 relative to valve seat 44.

Figure 3:
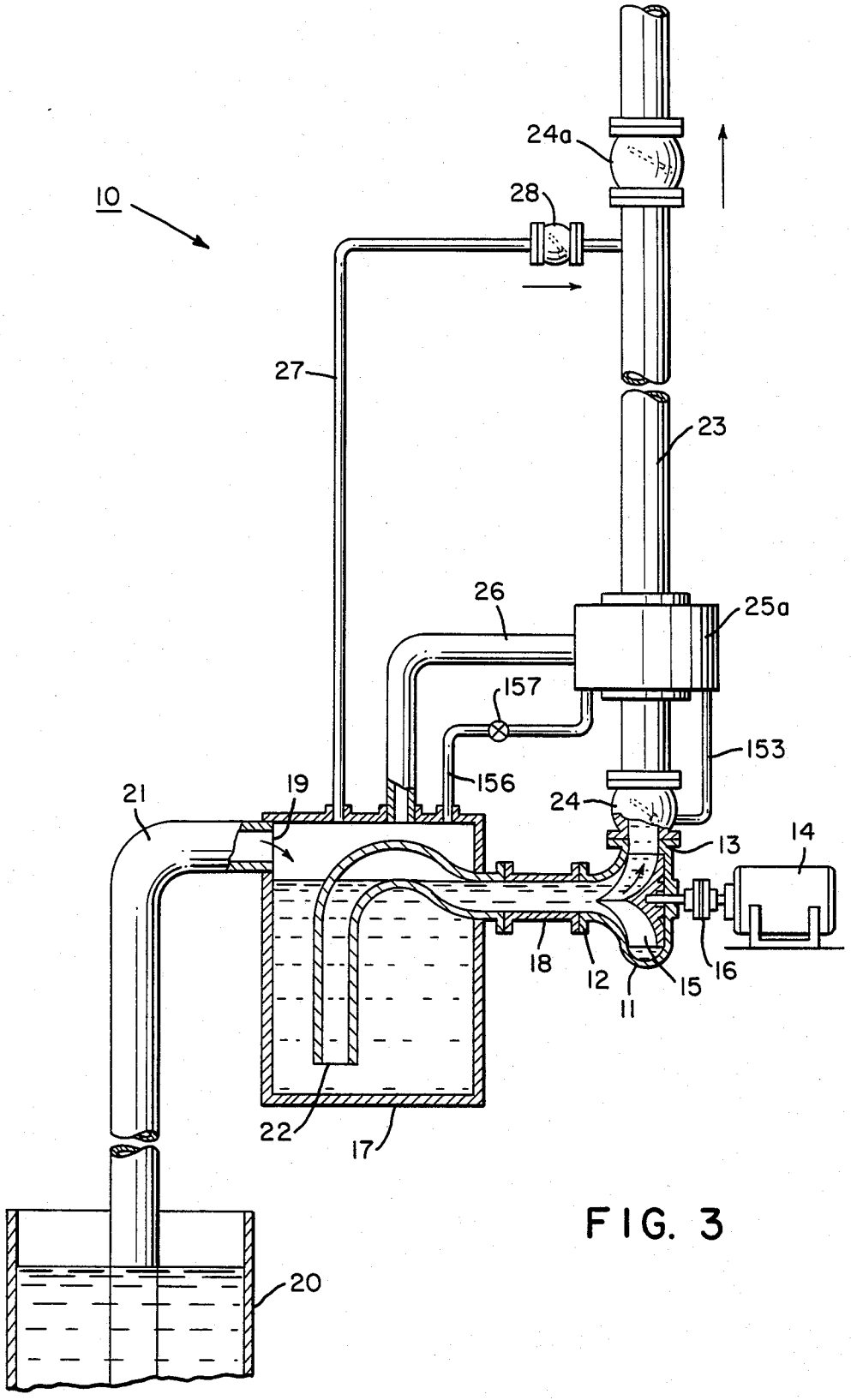
FIG. 3 is a view similar to FIG. 1 of another embodiment of a flow system incorporating a priming valve.

Another embodiment of the invention is shown in FIG. 3 wherein the priming valve is contained within a casing 25*a*, which encloses both the valve and a portion of discharge line 23. As in the embodiment shown in FIG. 1, a priming liquid conduit 26 extends from casing 25*a* to suction tank 17. In all other respects the elements of the FIG. 3 embodiment are the same as those of the FIG. 1 embodiment and the several common parts of each bear the same reference numerals.

Figure 4:
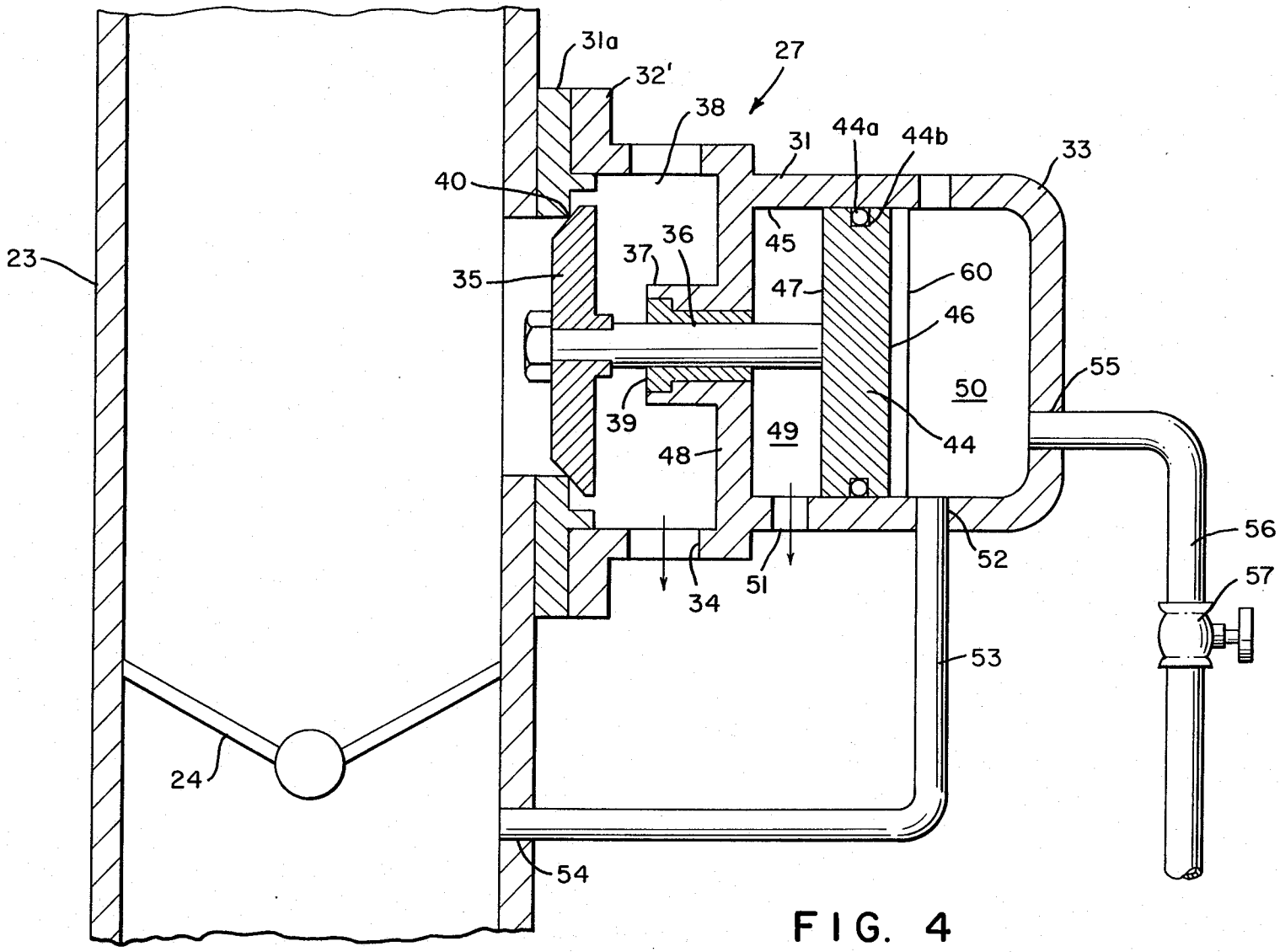
FIG. 4 is a fragmentary cross-sectional view of another embodiment of a priming valve.

Referring now to FIG. 4, there is shown a portion of discharge line 23 and priming valve 27 in accordance with another aspect of the present invention. Valve 27 includes a hollow, generally cylindrical housing 31 which is secured to an opening in discharge line 23 by means of a flange 32 at one end of the housing, which flange is secured to the discharge line as by means of bolts or the like (not shown), and a suitable annular adapter 31*a* which permits valve 27 to be used with certain existing priming systems to thereby provide a retrofit of such systems. Housing 31 is closed at its opposite end by means of an end cap 33 which can be externally threaded to engage corresponding internal threads on the end of housing 31. At least one generally radial aperture 34 is provided through the wall of housing 31. In its preferred form, housing 31 incorporates a number of such apertures 34 positioned about the periphery of the housing, and at a point adjacent flange 32.

Positioned within housing 31 is a disc-shaped valve member 35 which is secured to one end of a rod 36 slidably supported in a hub 37, which is connected to housing 31 by a plurality of radially directed connecting ribs 38. Between the respective connecting ribs are passageways which permit fluid to flow therethrough. A replaceable sleeve bearing 39 can be provided in hub 37 in order to minimize frictional resistance to axial sliding of rod 36 within housing 31.

Annular adapter 31*a* includes a valve seat 40 which is positioned at the end thereof adjacent discharge line 23. Valve member 35 is adapted to move into and out of covering engagement with valve seat 40 to close and open the valve, respectively.

Positioned on rod 36 and spaced from valve member 35 is a piston 44, which has a cross-sectional area greater than the cross-sectional area of valve member 35. Piston 44 is slidably carried in a bore 45 formed in housing 31, and can include a peripheral sealing member 44*a* in the form of an O-ring, or the like, which can be received in a suitable peripheral recess 44*b* formed in the outer surface of piston 44. Piston 44 divides bore 45 into a first chamber 49 and a second chamber 50.

Piston 44 includes a face 46, which is inwardly directed relative to discharge line 23, and an outwardly directed face 47. Positioned within housing 31 and defining the inner end wall of bore 45 is a transverse wall 48 which, together with bore 45 and face 47, defines first chamber 49. Similarly, second chamber 50 is defined by piston 44, bore 45, and end cap 33. Extending from first chamber 49 to the atmosphere around priming valve 27 is an aperture 51 to provide a constant atmospheric pressure therein.

Extending from second chamber 50 through the wall of housing 31 is a first aperture 52 which is adapted to receive one end of a sensing tube 53, the opposite end of which is positioned in an aperture 54 in discharge line 23 at a point slightly upstream of first check valve 24. A second aperture 55 is positioned to permit communication between chamber 50 and suction tank 17 by means of a conduit 56. Positioned in conduit 56 is a suitable control valve means 57, which can be a needle valve, or the like, whereby the amount of liquid flow through conduit 56, and consequently the pressure within chamber 50 can be regulated. If desired, conduit 56 can be interconnected with sensing tube 53 by means of a tee connection (not shown).

Positioned adjacent piston 44 and between piston 44 and end wall 33 is a resilient diaphragm 60 which is movable axially within bore 45 and is in sealing arrangement therewith. Diaphragm 60 can be formed from rubber, neoprene, or similar elastomeric materials, and serves as a barrier between the liquid in chamber 50 and piston 44 so that if gritty fluids are pumped through the system the grit will not cause excessive wear of the periphery of piston 44 or of bore 45. A quantity of suitable lubricant can be interposed between diaphragm 60 and piston 44 to lubricate the surface of bore 45 contacted by piston 44.

Figure 5:
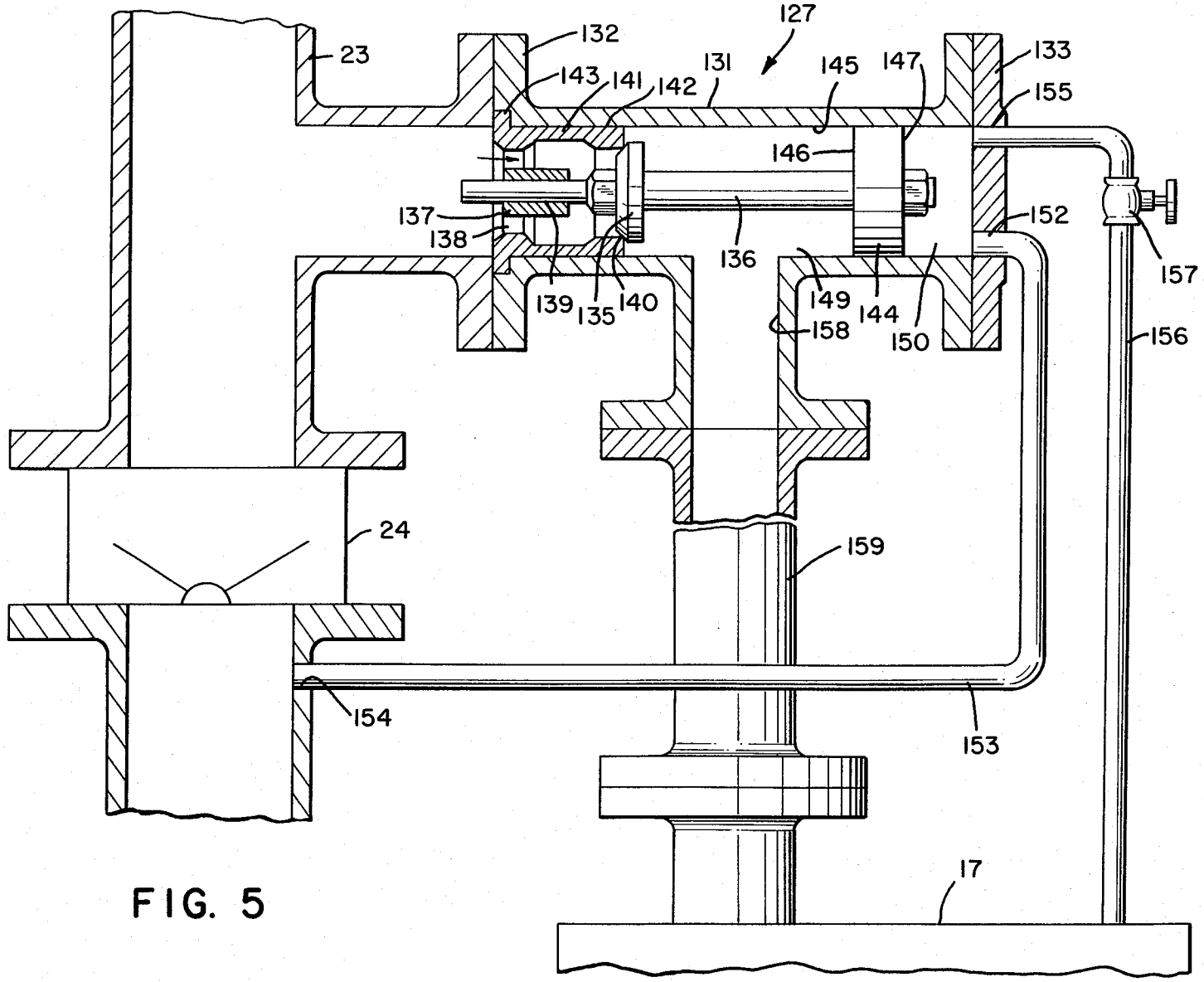
FIG. 5 is a view similar to that of FIG. 4 showing still another priming valve embodiment.

A further embodiment of a priming valve in accordance with the present invention is illustrated in FIG. 5, wherein a similar valve member 35-rod 36-piston 44 arrangement is shown. The arrangement of priming valve 127 in the embodiment of FIG. 5 is different from that of the embodiment shown in FIG. 4 in that enclosure 25*a* as shown in FIG. 3 is not needed in the embodiment of FIG. 5 because housing 31 is a T-shaped structure similar to housing 29 of the FIG. 2 embodiment. Fluid outlet 158 from valve 127 is in communication with a suitable conduit 159, which can be connected directly with suction tank 17, and thus an enclosure 25*a* such as is illustrated in connection with the embodiment of FIG. 3 is not required. In other respects, except for the valve seat and supporting sleeve arrangement already described, and the fact that first chamber 49 is vented to the interior of enclosure 26 in the FIG. 4 embodiment and is in direct communication with suction tank 17 through conduit 59 in the FIG. 3 embodiment, the two embodiments are similar both in structure and in operation. Counterparts in FIG. 5 or parts in FIG. 4 bear same reference number increased by 100.

In the operation of the embodiment of FIGS. 3 and 4, when a suitable quantity of liquid is present in suction tank 17 so that pump 11 draws liquid therefrom and pumps it into and through discharge line 23, each of check valves 24 and 24*a* is in the open condition to permit flow therethrough. Under that operating condition there is a static pressure head within discharge line 23 which acts upon valve member 35 and results in a force thereon in the direction tending to urge valve member 35 away from valve seat 40. The same static pressure force is conveyed to chamber 50 and to the outward face 47 piston 44 by means of conduit 53, and because the cross-sectional area of piston 44 is greater than that of valve member 35, the force exerted on piston 44 exceeds that exerted on valve member 35, and thus the valve is maintained in a closed condition. The pressure within chamber 50 is controlled by the position of control valve 57, which permits bleed-off of liquid from chamber 50.

If for one reason or another pump 11 exhausts the liquid in suction tank 17, thereby resulting in a no-flow condition from pump outlet 13, the liquid in the column defined between check valves 24 and 24*a* exerts a static pressure force against the outer face of valve member 35, again urging it away from valve seat 40 to attempt to permit flow therethrough. In this condition, however, the flow upstream of check valve 24 is zero, and the pressure therein is also zero, or atmospheric, with the consequence that the force acting upon valve member 35 exceeds the force exerted on piston 44, so that valve member 35 moves away from valve seat 40, thereby opening priming valve 27 and permitting liquid to pass around valve seat 40 and valve member 35, and into the discharge conduit 159 (FIG. 5) or through radial apertures 34 (FIG. 4), depending upon which embodiment of the valve structure is employed. The liquid in the column thus returns to suction tank 17, and permits pump 11 to once again develop sufficient suction to cause additional fluid from storage tank 20 to pass to suction tank 17 to provide liquid for continued pump operation.

In FIG. 5, conduit 156 can be connected by a tee to sensing tube 153 at a point upstream of control value means 157, thereby eliminating aperature 155.

While particular embodiments of the present invention have been illustrated and described, it will be apparent to those skilled in the art that various changes and modifications can be made without departing from the spirit and scope of the invention, and it is intended to encompass within the appended claims all such changes and modifications which fall within the scope of the present invention.

What is claimed is:

1. In a self-priming pump system for a liquid pump having a fluid inlet and a fluid outlet, a suction tank for the liquid to be pumped, the suction tank being in communication with the pump inlet, a discharge line connected to the pump outlet, a check valve positioned in the discharge line downstream of the pump outlet a distance sufficient to provide a column of priming liquid of a quantity sufficient for priming the pump upon loss of suction at the pump inlet, and a priming valve positioned between the pump outlet and the check valve and having an inlet in communication with the discharge line and an outlet in communication with the suction tank, the priming valve responsive to liquid flow from the pump to automatically permit flow of the priming column of liquid from the discharge line to the suction tank, the improvement comprising:

a. a second check valve positioned between the priming valve and the pump outlet to define a quantity of liquid between said check valves when flow through the pump ceases, said priming valve including a piston operated valve member having a rod connected to said piston, one face of said piston exposed to the discharge line static pressure at a point upstream of said second check valve and forming one wall of a piston pressure chamber, and the other side of said piston exposed to a pressure not exceeding atmospheric pressure;

b. a conduit extending from said piston pressure chamber to said suction tank, and control valve means positioned in said conduit to control the flow of liquid therethrough.

2. The self-priming pump system of claim 1 wherein said priming valve is positioned within an enclosure and the outlet of said valve is in communication with said enclosure and includes a return line for liquid to be returned to the suction tank.

3. The self-priming pump system of claim 1 wherein said priming valve includes a poppet valve cooperatively positioned relative to a valve seat.

4. The self-priming pump system of claim 1 wherein said priming valve includes a valve body that carries a removable sleeve in fluid-tight relationship with said valve body and which includes a valve seat and rod supporting means.

5. The self-priming pump system of claim 1 wherein the priming valve is T-shaped.

6. The self-priming pump system of claim 1 wherein said control valve means is a needle valve.

7. A priming valve for use in a self-priming pump system, said valve comprising a valve housing having a liquid inlet and a liquid outlet, a rod slidably supported in said valve housing, a valve member carried by said rod and supported for movement between the liquid inlet and the liquid outlet of said valve housing, a valve seat positioned within said valve housing and cooperable with said valve member to selectively permit or prevent flow through said valve, a plurality of pistons within said valve housing and carried by said rod, a plurality of spaced piston chambers each of which slidably receives one of said pistons, means to bias said valve member to the open position, and conduit means for interconnecting each of said piston chambers with a liquid flow conduit, whereby during times when liquid flow takes place through the liquid flow conduit the forces resulting from the liquid pressure in the liquid flow conduit acting on said pistons overcomes the combined force of said spring and the force resulting from liquid pressure acting against said valve member to maintain said valve against said seat so the primary valve is in the closed position, and during times when no liquid flow takes place through the liquid flow conduit the forces resulting from the liquid pressure acting on said pistons is insufficient to overcome the combined force of said spring and the force resulting from liquid pressure acting against said valve member, to cause said valve member to move away from said valve seat so the priming valve is open.

8. The priming valve of claim 7 wherein each of said plurality of pistons has correspondingly oriented faces subjected to the liquid pressure existing in the liquid flow conduit, the combined pressures thereof acting in opposition to the combined forces provided by the liquid pressure acting on said valve member and the force resulting from said biasing means.

9. The priming valve of claim 8 wherein said pistons are coaxially positioned on a rod slidable within said valve housing.

10. The priming valve of claim 9 wherein said valve member is carried on said rod.

11. The priming valve of claim 10 wherein each of said pistons is of unequal size.

12. The priming valve of claim 11 wherein one piston has an effective area which is equal to the effective area of said valve member, and wherein liquid pressure provided from a common source acts upon the oppositely-positioned faces of each of said valve member and said piston in order to provide equal and opposite counterbalancing forces on said rod.

13. The priming valve of claim 12 wherein the piston which is outermost relative to the valve member has the largest area of the several pistons, and has its side facing the valve member exposed to the atmosphere.

14. The priming valve of claim 13 wherein said valve seat is replaceable and is formed on a sleeve member adapted to be positioned within said valve housing, said sleeve incorporating bearing means for supporting said rod.

15. The priming valve of claim 14 wherein said sleeve member includes means for limiting the inward movement thereof.

16. The priming valve of claim 15 wherein said bearing is replaceable.

17. The priming valve of claim 16 wherein said spring acts on the outermost of said plurality of pistons.

* * * * *